US011441347B2

(12) United States Patent
Hall et al.

(10) Patent No.: US 11,441,347 B2
(45) Date of Patent: Sep. 13, 2022

(54) MECHANISM FOR OPENING AND CLOSING AN OVERHEAD DOOR INCLUDING ONE WAY BEARING

(71) Applicant: Hall Labs LLC, Provo, UM (US)

(72) Inventors: David R Hall, Provo, UT (US); Jerome Miles, Spanish Fork, UT (US); David J Groesbeck, Williamson, NY (US)

(73) Assignee: Hall Labs LLC, Provo, UT (US)

( * ) Notice: Subject to any disclaimer, the term of this patent is extended or adjusted under 35 U.S.C. 154(b) by 151 days.

(21) Appl. No.: 16/805,771

(22) Filed: Feb. 29, 2020

(65) Prior Publication Data

US 2021/0270079 A1 Sep. 2, 2021

(51) Int. Cl.

| | |
|---|---|
| ***E05F 15/686*** | (2015.01) |
| ***E05F 15/684*** | (2015.01) |
| ***E05B 65/00*** | (2006.01) |
| ***E06B 3/70*** | (2006.01) |

(52) U.S. Cl.

CPC ..... *E05F 15/686* (2015.01); *E05B 65/0021* (2013.01); *E05F 15/684* (2015.01); *E06B 3/70* (2013.01); *E05Y 2201/216* (2013.01); *E05Y 2201/628* (2013.01); *E05Y 2400/36* (2013.01); *E05Y 2900/106* (2013.01); *E06B 2003/7044* (2013.01)

(58) Field of Classification Search

CPC ..... E05F 15/686; E05F 15/684

See application file for complete search history.

(56) References Cited

U.S. PATENT DOCUMENTS

| | | | | |
|---|---|---|---|---|
| 3,719,005 | A * | 3/1973 | Carli | E05F 15/41 49/28 |
| 3,851,125 | A * | 11/1974 | Deming | E05F 15/673 200/47 |
| 4,860,813 | A * | 8/1989 | Ballyns | B60J 5/125 160/188 |
| 6,276,744 | B1 * | 8/2001 | Huber | B60J 5/14 160/181 |
| 2015/0315793 | A1 * | 11/2015 | Deutsch | E05F 1/1091 49/324 |
| 2021/0270067 | A1 * | 9/2021 | Hall | E05D 13/1261 |
| 2021/0270078 | A1 * | 9/2021 | Hall | E05F 15/684 |
| 2021/0396059 | A1 * | 12/2021 | Hall | E05F 15/686 |
| 2021/0404239 | A1 * | 12/2021 | Hall | E05F 15/41 |

FOREIGN PATENT DOCUMENTS

DE 20 2013 005 489 * 9/2013

* cited by examiner

*Primary Examiner* — Gregory J Strimbu

(57) ABSTRACT

An overhead door opener for opening and closing an overhead door. A motor is coupled to a shaft and is configured to rotate the shaft to raise and lower the overhead door. The shaft is coupled to the overhead door. The overhead door opener also includes a one-way bearing coupling the motor to the shaft, wherein the one-way bearing is configured to transmit torque from the motor to the shaft, and not to transmit torque from the shaft to the motor.

20 Claims, 3 Drawing Sheets

MECHANISM FOR OPENING AND CLOSING AN OVERHEAD DOOR INCLUDING ONE WAY BEARING

TECHNICAL FIELD

The present disclosure is directed to apparatuses, systems, and methods for raising and lowering an overhead door.

BACKGROUND

This invention relates to systems and methods for raising and lowering overhead door such as a garage door, commercial door, roller door, or loading doors, etc. Conventional methods for opening and closing overhead doors include some form of stopping mechanism. Many employ optical sensors near the ground to stop the garage if an impediment enters the field of vision of the sensors, or torque limiters and force-feedback mechanisms. An optical sensor near the ground has a limited field of view and may not stop the overhead door if an impediment is not in the field of view. There is a need in the art for an improved, reliable, and safe mechanism to raise and lower overhead doors.

SUMMARY

Embodiments of the present disclosure are directed to an overhead door opener for opening and closing an overhead door. The overhead door opener includes a motor coupled to a shaft and being configured to rotate the shaft to raise and lower the overhead door. The shaft is coupled to the overhead door. The overhead door opener also includes a one-way bearing coupling the motor to the shaft. The one-way bearing is configured to transmit torque from the motor to the shaft, and not to transmit torque from the shaft to the motor.

Further embodiments of the present disclosure are directed to an overhead door opener, including a motor, and a shaft carrying a door. The shaft is coupled to the motor by a first transmission component and a second transmission component. The overhead door opener also includes a one-way bearing coupling the first transmission component to the second transmission component to transmit torque from the motor to the shaft, but to allow rotation of the first component relative to the second transmission component if torque is applied from the shaft to the motor. The motor is configured to raise and lower the door by applying power to the shaft.

The overhead door opener also includes a first monitor coupled to the first transmission component and configured to observe rotation of the first transmission component, and a second monitor coupled to the second transmission component and configured to observe rotation of the second transmission component. A comparison between the rotation of the first and second transmission components is used to stop the motor if the comparison deviates from an expected value by more than a predetermined threshold amount.

Still further embodiments of the present disclosure are directed to an overhead door including a shaft, a door, and a cable connected to the door and to the shaft and configured to wind around the shaft to raise and lower the door. The overhead door also includes a motor and a one-way bearing comprising a first component coupled to the motor and a second component coupled to the shaft. The first and second components do not rotate relative to one another in a first rotational direction to allow the motor to apply torque to the shaft, and the first and second components rotate relative to one another when torque is applied from the shaft to the motor. Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the present disclosure. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

A one-way bearing is any device that is capable of transmitting torque when rotated in one direction, but does not transmit torque when rotated in the opposite direction. Many one-way bearings have two pieces that rotate relative to one another when rotated in the direction in which torque is not transmitted, and that do not rotate relative to one another when rotated in the opposite direction. Some examples of a one-way bearing are one-way clutch bearings or Sprag style bearings that are constructed from a drawn cup with needle roller clutches and have a small radial section height. They are often called one-way bearings, anti-reverse bearings and clutch bearings. Preferably, the units are compact, lightweight and operate directly on a shaft; they are also suitable for transmitting high torque.

Figure 1:
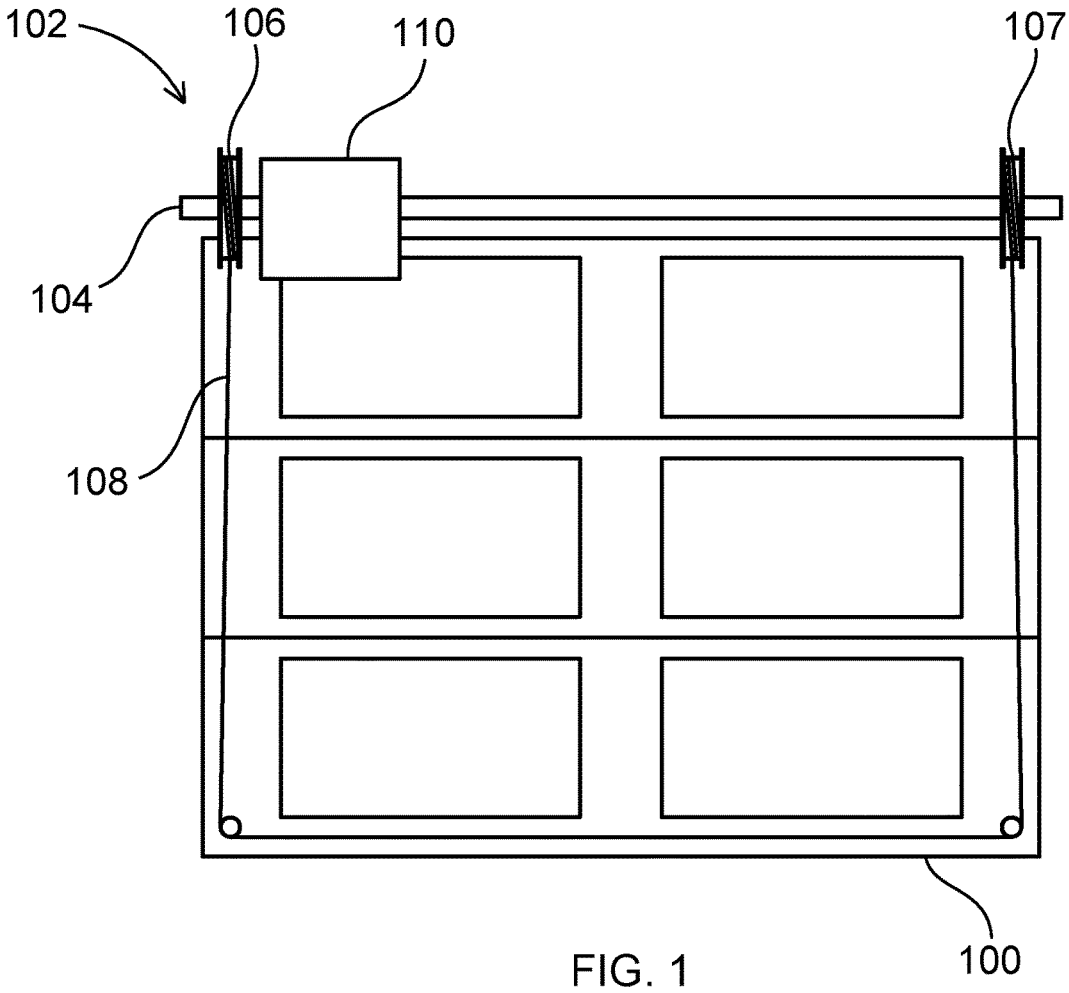
FIG. 1 is a front view of an overhead door according to embodiments of the present disclosure.

FIG. 1 is a front view of an overhead door 100 according to embodiments of the present disclosure. Many homes have overhead doors that are used to enter a garage. Many residential overhead doors are used for automobiles and are opened via a remote control in the car and in the garage to open and close the overhead door. The overhead door 100 of the present disclosure is coupled to an opener 102 which includes a shaft 104, spools 106 and 107 at either end of the shaft 104, and a cable 108 that connect to the spools and to the overhead door 100. A motor unit 110 is coupled to the shaft 104 and turns the shaft 104 which turns the spools 106, 107 and winds the cable 108 onto and off of the spools 106, 107 to raise and lower the overhead door 100, respectively. In some embodiments the cable are a single cable that extends from one spool 106 to the overhead door 100 and along the lower edge and up to the other spool 107. In other embodiments there can be a single spool on one side of the shaft 104. In still further embodiments the spool is centrally located and the motor unit 110 winds the spool from the center of the overhead door 100.

Include explanation of roller door, etc.

In some embodiments the motor unit 110 is directly coupled to the shaft 104 to rotate the shaft 104 to operate the overhead door. In other embodiments the motor unit 110 is coupled to a belt drive or other mechanical system used to raise and lower the overhead door 100.

Figure 2:
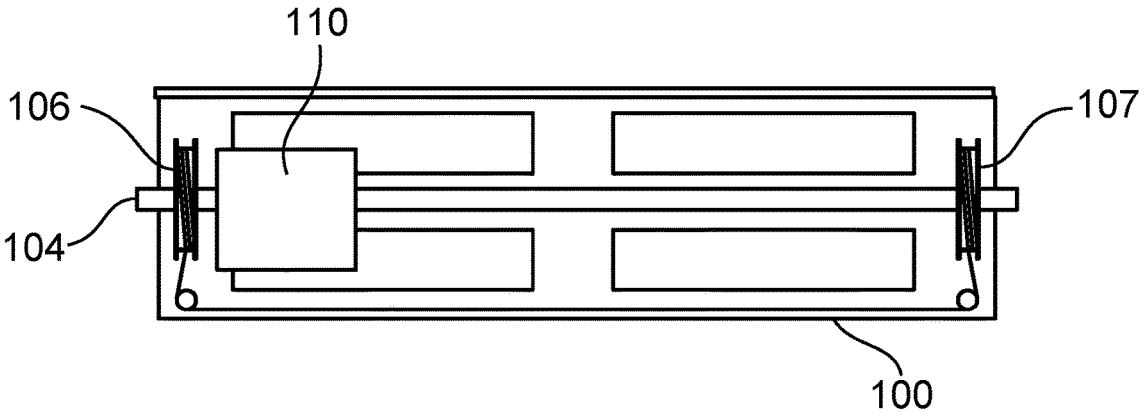
FIG. 2 is a view similar to FIG. 1, showing the overhead door in a lifted state with the spools wound up and the cables wound up to raise the overhead door according to an embodiment of the present disclosure.

FIG. 2 shows the overhead door 100 in a lifted state with the spools 106, 107 wound up and the cable 108 wound up to raise the overhead door 100. The overhead door 100 can be raised and lowered in response to a signal from a remote or a hard-wired control inside the garage or outside the garage.

Figure 3:
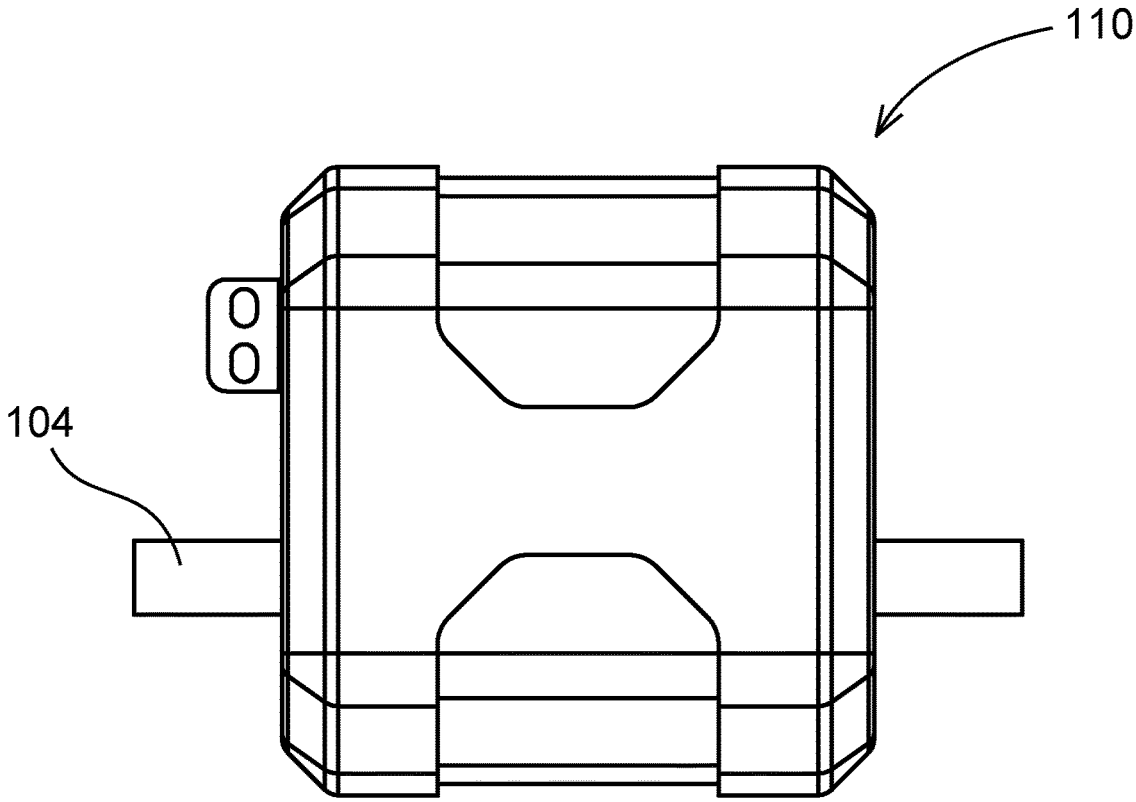
FIG. 3 is a view of the motor unit according to an embodiment of the present disclosure.

FIG. 3 shows the motor unit 110 according to embodiments of the present disclosure. A portion of the shaft 104 is shown protruding from either side of the motor unit 110. The motor unit 110 can be positioned anywhere on the shaft 104, including outside of the spools shown in FIGS. 1 and 2. The motor unit 110 can be installed onto the shaft after the overhead door and shaft 104 have been installed. In some embodiments, the motor unit 110 can be used to retrofit an existing overhead door without time and labor-intensive disassembly of the overhead door.

Figure 4:
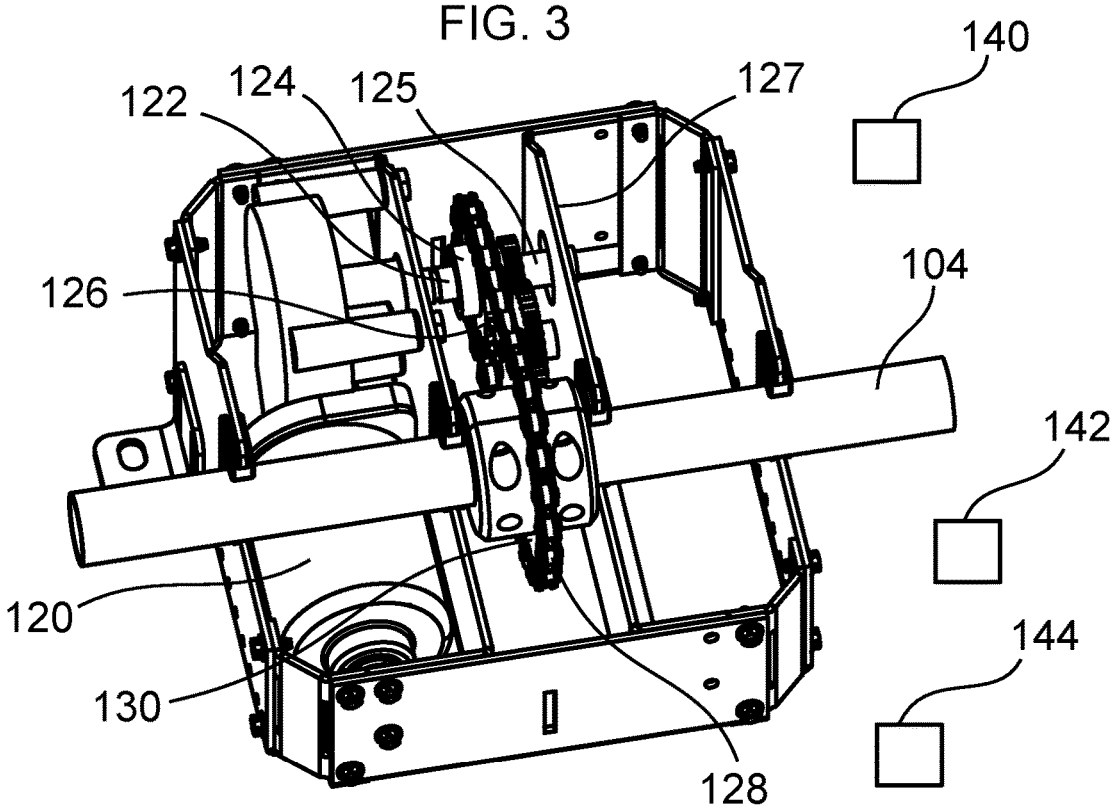
FIG. 4 is a view similar to FIG. 3, with the cover removed according to an embodiment of the present disclosure.

FIG. 4 shows the motor unit 100 with a cover removed according to embodiments of the present disclosure. The motor unit 110 includes a motor 120 having an output shaft 122 receiving the mechanical power from the motor 120 to raise and lower the overhead door by turning the shaft 104. The output shaft 122 has a one-way bearing 124 coupled to the output shaft 122 and a sprocket 126 coupled to the one-way bearing 124. A one-way bearing is any device that is capable of transmitting torque when rotated in one direction, but does not transmit torque when rotated in the opposite direction. Many one-way bearings have two pieces that rotate relative to one another when rotated in the direction in which torque is not transmitted, and that do not rotate relative to one another when rotated in the opposite direction. Some examples of a one-way bearing are one-way clutch bearings or Sprag style bearings that are constructed from a drawn cup with needle roller clutches and have a small radial section height. They are often called one-way bearings, anti-reverse bearings and clutch bearings. The units are compact, lightweight and operate directly on a shaft; they are also suitable for transmitting high torque.

A chain 128 is coupled to the sprocket 126. The shaft 104 is shown carrying a sprocket 130 that engages with the chain 128. Mechanical power is therefore transmitted from the motor 120, to the one-way bearing 124, through the sprocket 126, the chain 128, and delivered to the sprocket 130 which turns the shaft 104 to raise and lower the overhead door. In some embodiments the chain 128 can be replaced by any suitable mechanical equivalent, such as meshing gears, a belt, or any other suitable mechanical equivalent capable of delivering torque and power to the shaft 104.

The one-way bearing 124 is designed to transmit torque when the motor turns in a first direction that causes the overhead door to raise. The one-way bearing 124 also transmits torque in the first direction when the motor 120 is operated in reverse to lower the overhead door. The weight of the door on the bearing creates the torque in the first direction as the door is raised and lowered. The "first direction" is an angular direction when referring to the torque applied by the one-way bearing 124. Movement in a second direction opposite the first direction, however, causes the one-way bearing 124 to rotate freely. The one-way bearing 124 can be made of two separate parts, one coupled to the output shaft 122 and one coupled to the sprocket 126. These parts are not allowed to rotate relative to one another in the first direction, but are allowed to rotate relative to one another in the second direction. Accordingly, the motor 120 cannot transmit torque in the second direction to the overhead door. The motor 120 can transmit torque to the shaft 104, but the shaft 104 cannot transmit torque to the motor 120. Of course, no bearing is completely devoid of torque. There may be some resistance and friction, but the overall effect is as close to zero transmitted torque as is practically possible. When the overhead door is lowered and contacts an impediment that stops downward movement of the overhead door, it will cause a torque to be applied through the door and into the shaft 104. The one-way bearing 124 will not transmit this torque and will also therefore prevent the motor 120 from exerting a downward force on the door. The only downward force then is the weight of the door itself, which can be balanced by a spring as is known in the art. The one-way bearing 124 is therefore a safety mechanism that does not require any power to operate.

When the door is in a fully or mostly retracted position, most of the weight of the door is supported by components such as upper rails (not shown) above the shaft 104 and therefore the weight is not acting on the shaft 104. If there is insufficient weight on the shaft 104 to cause the shaft 104 to rotate and lower the door, the motor 120 needs to apply downward torque to the shaft 104. However, the one-way bearing 124 prevents such torque in part to prevent downward torque from causing an injury. To address this, an electro-mechanical clutch 125 may be coupled to the one-way bearing 124. The electro-mechanical clutch 125, when activated, fixes the one-way bearing and fixes the one-way bearing, effectively converting the one-way bearing 124 into a rigid coupling fastened to the shaft 104 that is capable of transmitting torque in both directions. When the electro-mechanical clutch 125 is not activated, the one-way bearing 124 operates as a one-way bearing.

The electro-mechanical clutch 125 can be configured to operate for a first distance of travel of the door. For example, the first two feet of movement is in some embodiments sufficient distance for the weight of the door to provide the downward force to close the door. In other embodiments a tension monitor 127 can be used to monitor the tension on the electro-mechanical clutch 127 and if the tension reaches a certain level it will release the one-way bearing 124. The electro-mechanical clutch 125 can be operated with power from a power supply (not shown) to the motor or from the motor or from another outlet in the garage. The electro-mechanical clutch 125 can be configured to fail open, meaning that in the event of power loss the electro-mechanical clutch 125 does not grasp the one-way bearing, permitting the door to be opened manually, and not to exert a downward force onto the door.

As a result, any blockage of the downward movement of the door will cause the one-way bearing 124 to spin. The spools (refer to FIGS. 1 and 2) will immediately stop spinning, and even though the motor 120 may continue to rotate, the spools will not continue to rotate and create slack in the cables. Also, the downward force of the door is limited to the weight of the door. In some embodiments, this weight is counterbalanced by a torsion spring on the shaft to further reduce the weight of the door as it moves upward and downward. The torsion spring is connected at one end to the shaft and at the other end to a stationary piece on the structure. The overhead door of the present disclosure is therefore safer and less prone to errors than conventional designs that require sensors and other electronic mechanisms such as force limiters and other similar devices to stop a downward force from causing damage to the source of the perhaps delicate item or person blocking the door. The stoppage of the downward force of the door is not subject to an electronic system working properly. The one-way bearing 124 requires no electronics, no communication, and no software to prevent a dangerous situation from harming someone who finds themselves under the door as it comes down.

The motor unit 110 can also include a monitor 140 operably coupled to the output shaft 122. The monitor 140 observes a velocity of the output shaft 122. The motor unit 110 can also include a second monitor 142 operably coupled to a component of the drive train, including any one or more of the chain 128, the sprocket 126, the sprocket 130, or the shaft 104. Even the portion of the one-way bearing 124 that is coupled to the sprocket 126 and does not necessarily rotate the same as the output shaft 122 of the motor can be monitored by the second monitor 142. Any component downstream from the one-way bearing 124 can be monitored by the second monitor 142. The second encoder 142 can be configured to monitor position and velocity and from these measurements, a position and velocity of the door itself can be calculated.

In some embodiments the monitors 140, 142 can be an encoder such as a rotary encoder, also called a shaft encoder. An encoder is an electro-mechanical device that converts the angular position or motion of a shaft or axle to analog or digital output signals. There are two main types of rotary encoder: absolute and incremental. The output of an absolute encoder indicates the current shaft position, making it an angle transducer. The output of an incremental encoder provides information about the motion of the shaft, which typically is processed elsewhere into information such as position, speed and distance. Rotary encoders are used in a wide range of applications that require monitoring or control, or both, of mechanical systems, including industrial controls, robotics, photographic lenses, computer input devices such as optomechanical mice and trackballs, controlled stress rheometers, and rotating radar platforms.

The first monitor 140 and second monitor 142 operate together to monitor slippage of the one-way bearing 124. When the torque is applied in the first direction, the two components of the one-way bearing 124 will not rotate relative to one another, but when the overhead door is stopped from moving downward, the one-way bearing rotates and this rotation difference will be measurable by the second monitor 142. A controller 144 can be coupled to the monitors and to the motor 120 and can operate to stop the motor 120 if the rotation deviates from the expected values by more than a predetermined quantity. The controller 144 can issue any of a series of commands in response to such rotational deviancy. The commands can include stopping the motor, issuing an alarm, retracting the door to a known "safe" place, recalibrating the door position, and issuing a notification to a mobile phone or a smart home system, etc.

The monitors 140, 142 and controller 144 are shown schematically. It is to be appreciated by a person of ordinary skill in the art that these components can be built into the motor 120, they can be wireless and/or remote, they can be attached to the shafts and components of the motor unit 110. It is understood how the monitors and controllers operate even without a detailed depiction.

Figure 6:
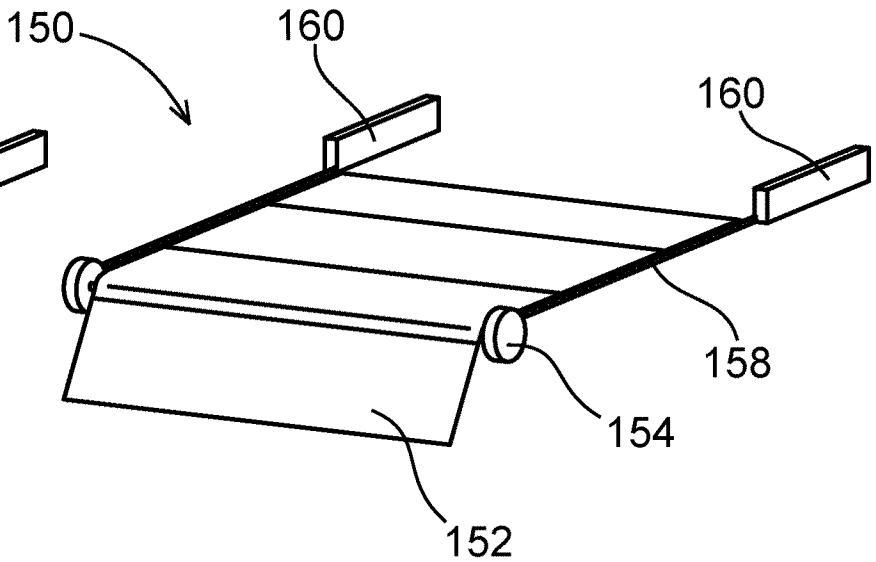
FIG. 6 shows an overhead door system according to embodiments of the present disclosure in a raised position.
Figure 5:
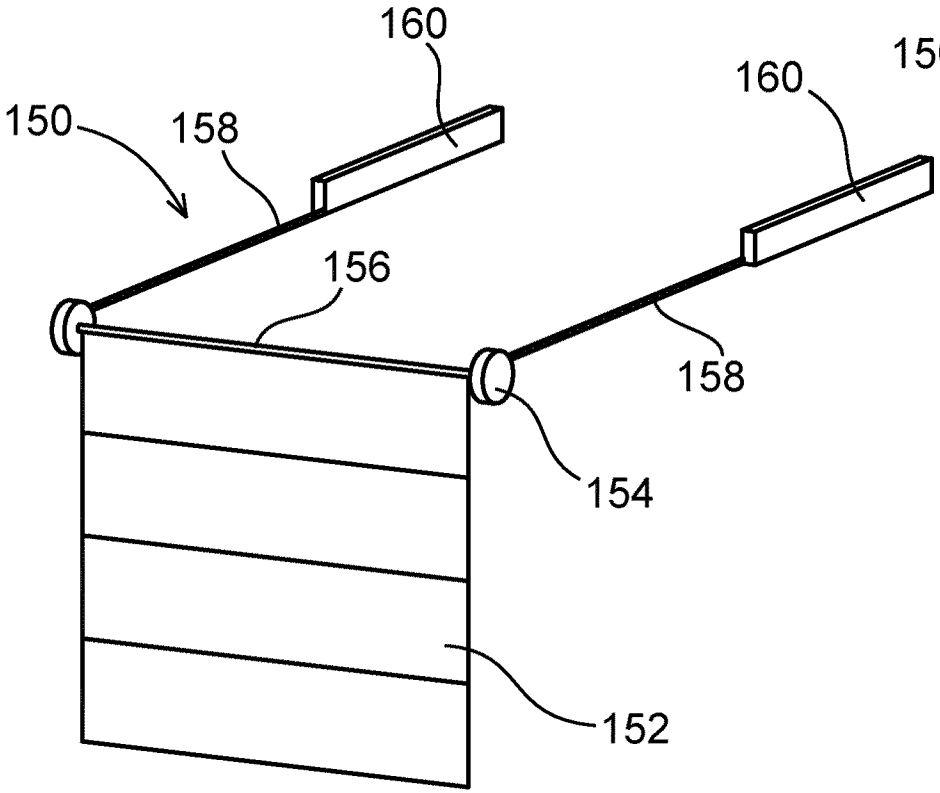
FIG. 5 shows an overhead door system according to embodiments of the present disclosure in a lowered position.

FIGS. 5 and 6 show an overhead door system 150 according to embodiments of the present disclosure in lowered and raised positions, respectively. The overhead door system 150 includes an overhead door 152, spools 154, and a shaft 156. The system 150 also includes rails 158 that guide the overhead door as it moves along a path overhead as the door 152 is raised. The system 150 also includes an energy storing device 160 at a rearward portion of the rails 158. As the overhead door 152 is raised it moves along the rails and moves rearward and imparts energy into the energy storing device 160. The energy storing device 160 may be a spring, a gas compressor, or any other suitable form of storing energy as provided by the overhead door 152 as it is raised and moves along the rails 158. In FIG. 6 the energy storing device 160 is compressed. In some embodiments the energy storing device 160 can be toward the front of the door and can be extended by moving the overhead door 152 rearwardly.

The foregoing disclosure hereby enables a person of ordinary skill in the art to make and use the disclosed systems without undue experimentation. Certain examples are given to for purposes of explanation and are not given in a limiting manner. All patents and published patent applications referred to herein are incorporated herein by reference.

The invention claimed is:

1. A mechanism for opening and closing an overhead door, comprising:

a shaft coupled to the overhead door and configured to rotate in a first direction to raise the overhead door and to rotate in a second direction to lower the overhead door; and a motor coupled to the shaft by a one-way bearing, wherein the one-way bearing is configured to transmit torque from the motor to the shaft in the first rotational direction, and wherein the one-way bearing is configured so that torque is not transmitted from the motor to the shaft in the second rotational direction;

whereby the one-way bearing allows the motor to apply torque to the shaft to raise the overhead door, and the one-way bearing does not allow the motor to apply torque to the shaft to lower the door.

2. The mechanism of claim 1 wherein the one-way bearing comprises a first component and a second component that are rotatable relative to one another.

3. The mechanism of claim 2, further comprising a monitor configured to monitor relative rotation between the first and second components.

4. The mechanism of claim 3, further comprising a controller configured to issue a command to the motor if the monitor detects rotation between the first and second components.

5. The mechanism of claim 4 wherein the command comprises at least one of:

a command to stop the motor;

a command to raise the overhead door to an overhead position; and a command to activate an alarm and.

6. The mechanism of claim 3 wherein the monitor comprises an encoder.

7. The mechanism of claim 3, further comprising a second monitor configured to monitor a rotation rate of the motor.

8. The mechanism of claim 3 wherein the monitor is configured to compare respective rotation rates of the first and second components and if the respective rotation rates differ by more than a predetermined amount the motor is stopped.

9. The mechanism of claim 1 wherein the shaft is coupled to a spool that winds a cable connected to the overhead door.

10. The mechanism of claim 1, further comprising an electro-mechanical device, the electro-mechanical device being configured to lock the one-way bearing and thereby render the one-way bearing capable of transmitting torque in both the first and second rotational directions.

11. The mechanism of claim 10, further comprising a force monitor coupled to the electro-mechanical device, wherein the force monitor is configured to measure a force applied to the electro-mechanical device.

12. An overhead door system, comprising:

a shaft with a spool coupled thereto;

an overhead door;

a cable connected to the door and to the spool and configured to wind onto and unwind from the spool to raise and lower the door, respectively;

a motor;

a one-way bearing comprising a first component coupled to the motor and a second component coupled to the shaft, wherein the first and second components do not rotate relative to one another in a first rotational direction to allow the motor to apply torque to the shaft to raise the overhead door, and wherein the first and second components rotate relative to one another in a second rotational direction opposite the first rotational direction to lower the overhead door while not allowing the motor to apply torque to the shaft.

13. The overhead door system of claim 12, further comprising first transmission components coupling the motor to the first component of the one-way bearing, and second transmission components coupling the shaft to the second component of the one-way bearing.

14. The overhead door system of claim 13 wherein the transmission components comprise one or more of sprockets, a chain, a belt, and gears.

15. The overhead door system of claim 12, further comprising a first monitor configured to monitor a velocity of the motor and a second monitor configured to monitor a velocity and angular position of the shaft.

16. The overhead door system of claim 12, further comprising a monitor configured to detect relative to rotation of the first component and the second component, the monitor being configured to stop the motor if the rotation deviates from an expected quantity by more than a threshold amount.

17. An overhead door system, comprising:

a motor;

a shaft;

an overhead door coupled to the shaft;

a one-way bearing coupling the motor to the shaft and being configured to transmit torque from the motor to the shaft in a first rotational direction, wherein the one-way bearing allows the motor to apply torque to the shaft in the first rotational direction to raise the overhead door, and the one-way bearing does not allow the motor to apply torque to the shaft in a second rotational direction opposite the first rotational direction while the door is lowered;

a monitor coupled to the one-way bearing and configured to observe relative rotation of components of the one-way bearing;

wherein the monitor is configured to stop the motor if the components of the one-way bearing rotate relative to one another more than a predetermined threshold amount.

18. The overhead door system of claim 17 wherein the monitor monitors at least one of angular position and angular velocity of the shaft.

19. The overhead door system of claim 17, further comprising transmission components coupling the motor to the one-way bearing, the transmission components comprising one or more of sprockets, a chain, gears, or a belt.

20. The overhead door system of claim 17, further comprising a cable coupled to the shaft and the door, the cable winding onto and unwinding from a spool on the shaft as the door is raised and lowered, respectively.

* * * * *